US007789225B2

(12) United States Patent
Whiteis

(10) Patent No.: US 7,789,225 B2
(45) Date of Patent: Sep. 7, 2010

(54) JEWELRY BOX

(76) Inventor: David Whiteis, 18429 Stone Hollow Dr., Germantown, MD (US) 20874

( * ) Notice: Subject to any disclaimer, the term of this patent is extended or adjusted under 35 U.S.C. 154(b) by 488 days.

(21) Appl. No.: 11/828,931

(22) Filed: Jul. 26, 2007

(65) Prior Publication Data

US 2008/0023357 A1 Jan. 31, 2008

Related U.S. Application Data

(60) Provisional application No. 60/820,547, filed on Jul. 27, 2006.

(51) Int. Cl.
*A45C 11/04* (2006.01)

(52) U.S. Cl. ..... 206/6.1; 396/429

(58) Field of Classification Search ..... 206/6.1, 206/566, 38, 216, 307; 84/94.2, 95.2; 346/25, 346/107.2; 348/61, 151, 211.13, E5.042; 362/104, 154–156; 386/113, 124; 396/429
See application file for complete search history.

(56) References Cited

U.S. PATENT DOCUMENTS 1,706,387 A 3/1929 Kramer
2,109,361 A 2/1938 Spiegel
3,244,086 A 4/1966 Craghead
3,672,269 A 6/1972 Tabankin
6,209,242 B1 4/2001 Marshall
6,405,858 B1 * 6/2002 Gagliardi ..... 206/6.1
6,554,499 B1 4/2003 Gumpenberger
6,990,463 B2 1/2006 Walter et al.
7,000,760 B2 2/2006 Lau
7,140,537 B2 11/2006 Blackson et al.
2003/0223730 A1 * 12/2003 Cornwell ..... 386/46
2004/0007119 A1 * 1/2004 Ra ..... 84/600
2007/0133980 A1 * 6/2007 Meyers et al. ..... 396/429
2007/0295619 A1 * 12/2007 Lee ..... 206/6.1

* cited by examiner

*Primary Examiner*—Luan K Bui

(57) ABSTRACT

An apparatus to record a user's reaction on a recordable medium. The apparatus includes a container having a top portion hingedly fixed to a bottom portion. An interior section of the container houses a recording device in communication with the bottom portion. At such time as the top portion and bottom portion are separated beyond a defined distance, the recording device becomes activated to record still image, audio, and/or video of a person within range of the recording device.

11 Claims, 3 Drawing Sheets

JEWELRY BOX

CROSS REFERENCE TO RELATED APPLICATION(S)

This is a non-provisional utility patent application claiming benefit of the filing date of U.S. provisional patent application Ser. No. 60/820,547, filed Jul. 27, 2006, and titled "Jewelry Box", which is hereby incorporation herein by reference.

BACKGROUND OF THE INVENTION

1. Technical Field

This invention relates to an apparatus and method for recording a user's face and facial expressions when opening a jewelry box. More specifically, the apparatus and method may be adapted such that a recording device is hidden within the lid of a jewelry box containing a piece of jewelry, in such a manner that opening the lid of the jewelry box activates the recording mode of the recording device. When the jewelry box is opened by a user, the user's facial expressions while opening the jewelry box are recorded.

2. Description of the Prior Art

A jewelry box is known in the prior art and is typically used by a first user to give a piece of jewelry to a second user. It is often desirable, by the first user, that the reaction of the second user to the gift be recorded. Such a recording, to date, has only been accomplished by a separate recording device such as a video camcorder or camera. Such devices are limited in that they can only capture the reaction and expressions of the second user from an indirect angle, and the full expression and reaction of the second user is unable to be fully recorded. Using such a device also requires the participation of a third party, which is often not desired because of the personal nature of the moment. Accordingly, a recording device is desired that can directly capture the full expression of the second user while opening a jewelry box given to him/her by a first user.

SUMMARY OF THE INVENTION

In one aspect of the invention, a storage apparatus is provided in the form of a container with a lid and a base. The lid has a top portion and an underside portion that meet at a first lip, and the base has a top portion and a bottom portion that meet at a second lip. The lid pivotably attached to the base by a hinge connected to the first lip and the second lip. The hinge allows for both an open configuration and a closed configuration of the container. A recording device is provided and mounted within the container such that when a user converts the container into the open configuration from the closed configuration, the recording device records the user.

In another aspect of the invention, a method is provided for recording. A container is opened by separating a lid from a base. The lid is hingably attached to the base. A recording device is positioned in an interior portion of the container for recording a user's reaction to opening the container using the recording device mounted within the container.

Other features and advantages of this invention will become apparent from the following detailed description of the presently preferred embodiment of the invention, taken in conjunction with the accompanying drawings.

DESCRIPTION OF THE PREFERRED EMBODIMENT

Overview

This invention relates to an apparatus and method for recording a user's reaction to opening a jewelry box comprising a jewelry box and a recording device. The jewelry box may be a standard size and shape of a traditional jewelry box with a lid and a base hingably attached wherein a piece of jewelry may be inserted within the base of the jewelry box. The recording device is mounted within the jewelry box such that when a user opens the lid of the jewelry box, the recording device is adapted to begin a recording of facial expressions of the user.

Technical Details

The present invention relates to a jewelry box containing a recording device hidden within the jewelry box. The recording device is adapted to record the facial expressions of the user upon opening the jewelry box.

Figure 2:
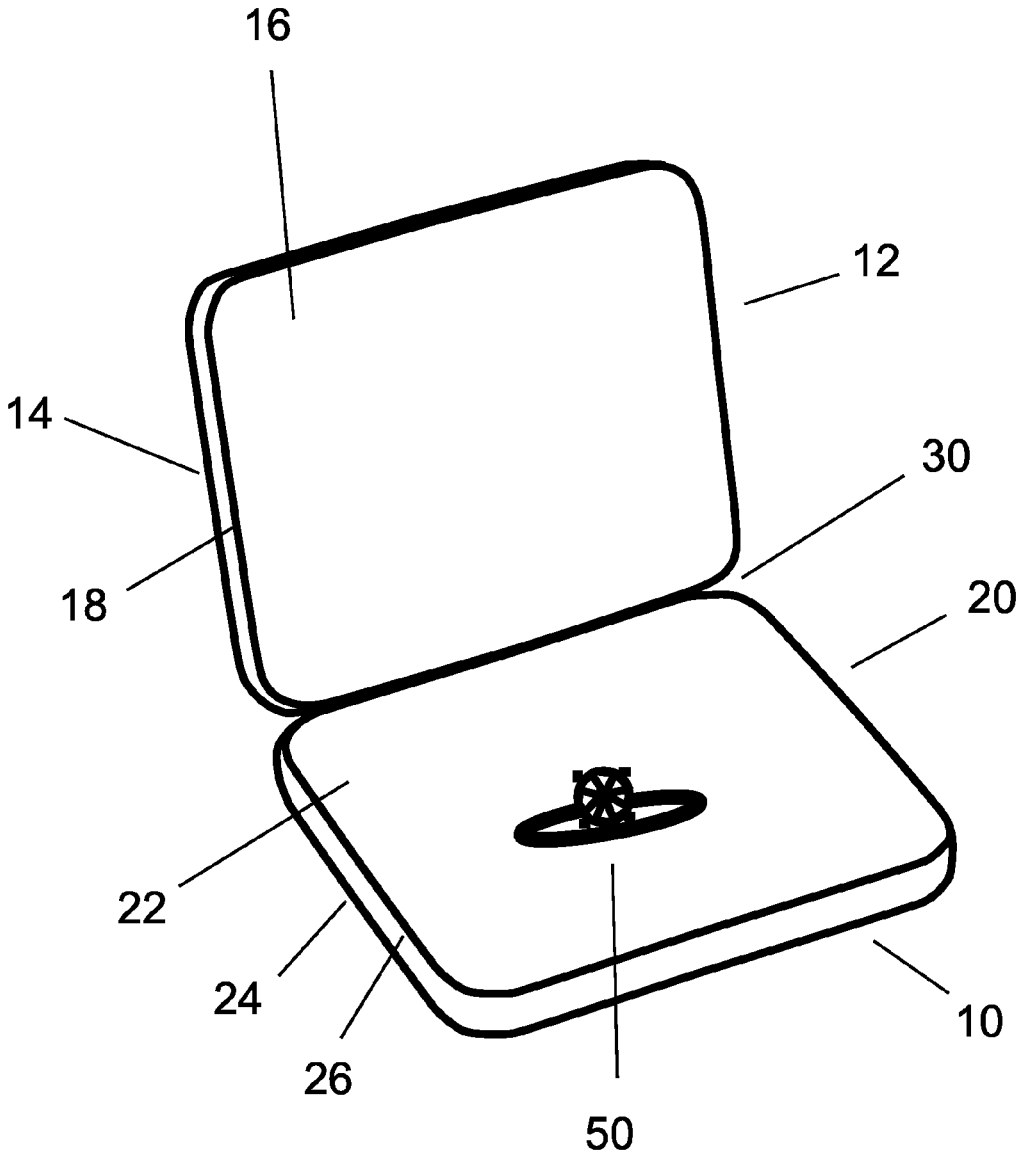
FIG. 2 is a drawing of the box while opened, and containing a piece of jewelry on the base of the jewelry box and a hidden recording device in the lid of the jewelry box.
Figure 3:
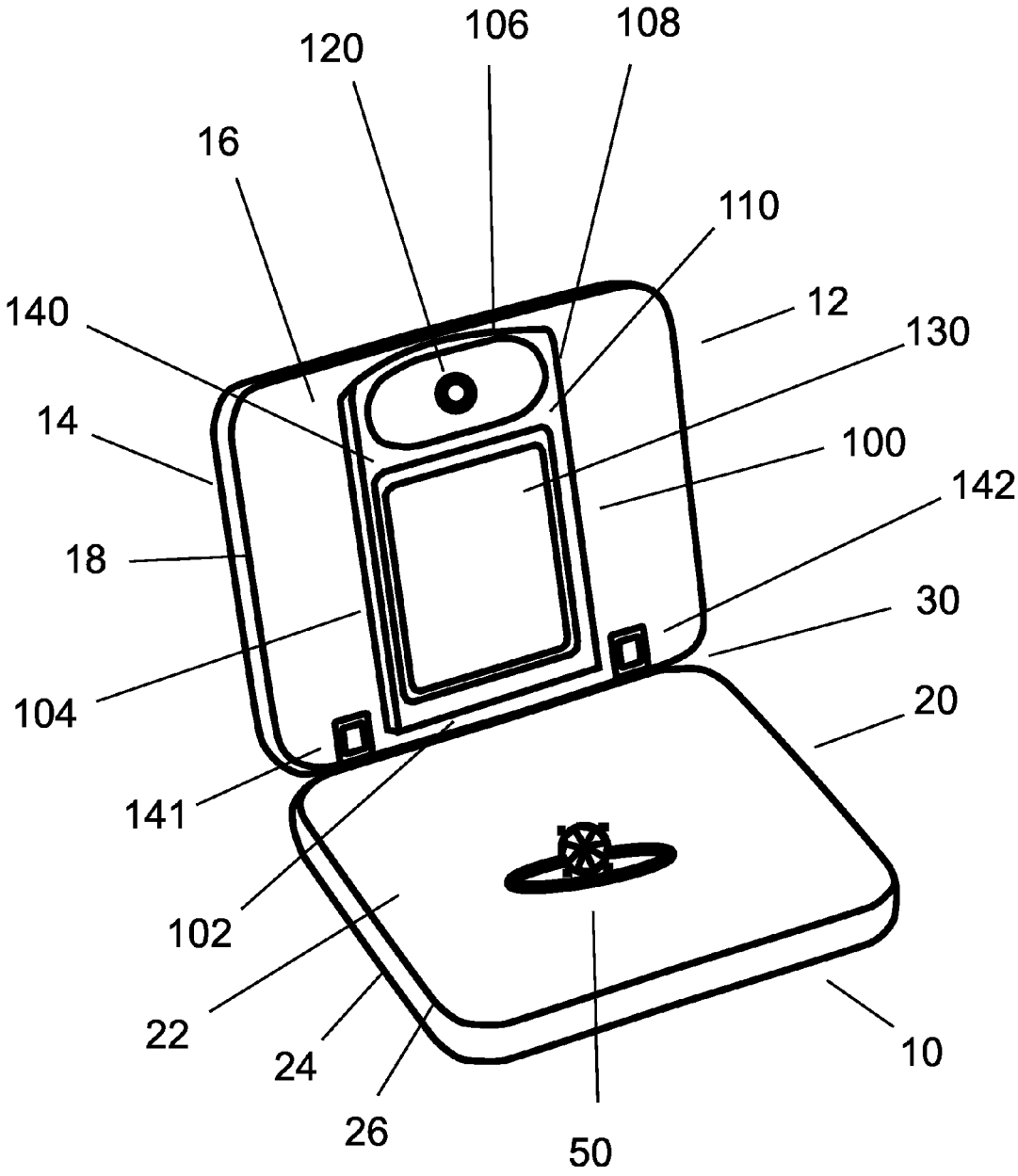
FIG. 3 is a drawing of an opened jewelry box containing a piece of jewelry on the base of the jewelry box and an embodiment of the exposed recording device in the lid of the jewelry box.

Referring to FIGS. 2 and 3, the jewelry box (10) is shown comprised of a lid (12) and a base (20). The lid (12) contains a top portion (14) and an underside portion (16) wherein the top portion (14) and the underside portion (16) meet at a first lip (18). The first lip (18) defines the circumference of the lid (12). The base (20) contains a top portion (22) and a bottom portion (24) wherein the top portion (22) and the bottom portion (24) meet at a second lip (26). The second lip (26) defines the circumference of the bottom portion (24). The lid (12) and the base (20) of the jewelry box (10) are held together by an attachment element (30) attached to the first lip (18) and the second lip (26). In one embodiment, the attachment element (30) is a hinge. However, the invention should not be limited to a hinge. For example, the attachment element (30) may also be a tension holding apparatus to connect the lid and base (12) and (20), respectively, with tension.

Figure 1:
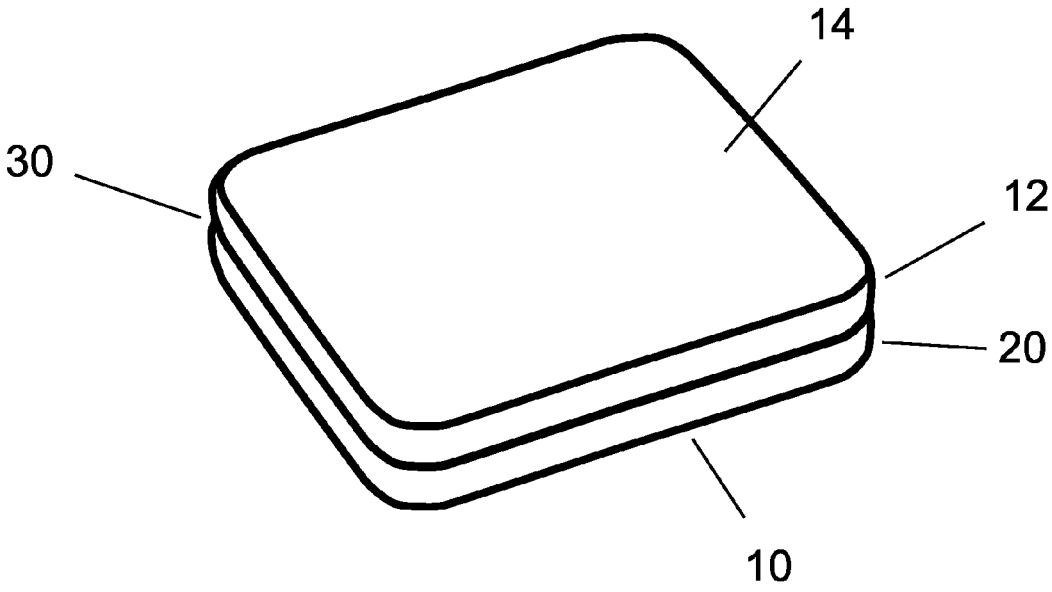
FIG. 1 is a drawing of the box while closed.

When the jewelry box (10) is in a closed configuration, such as illustrated in FIG. 1, the attachment element (30) holds the first lip (18) and the second lip (26) together such that the lid (12) is directly over the base (20). In one embodiment, neither the underside portion (16) of the lid (12) nor the top portion (22) of the base (20) is able to be seen when the first and second lips (18) and (26), respectively, are held together. Conversely, to convert the jewelry box (10) to an open configuration, such as illustrated in FIG. 2, the lid (12) is pivoted about the attachment element (30) and away from the base (20). The attachment element (30) then holds the lid (12) spaced apart from the base (20) such that the underside portion (16) of the lid (12) and the top portion (22) of the base (20) are exposed. In one embodiment, the attachment element (30) may hold the lid (12) in tension to maintain spacing between the base (20) and the top portion (22). Furthermore, in one embodiment, when the box (10) is in an open portion, the angle between the base (20) and the lid (12) is between 20 and 120 degrees.

The jewelry box (10) may contain a piece of jewelry (50). As illustrated in FIG. 2, the jewelry item (50) is located on the top portion (22) of the base (20) of the jewelry box (10). When the jewelry box (10) is in an open configuration the jewelry item (50) is able to be seen by the user. Conversely, when the jewelry box (10) is in a closed configuration, as illustrated in FIG. 1, the jewelry item (50) is unable to be seen by the user.

Referring to FIG. 3, a recording device (100) is present within the jewelry box (10). In one embodiment, the recording device has a planar shape comprising four edges (102), (104), (106), and (108), a front portion (110), a back portion (not illustrated), a lens (120), a display (130), a microphone (140), and a plurality of buttons (141), (142). However, the invention should not be limited to the planar shape shown herein. This shape is merely an example for illustrative purposes. As illustrated in FIG. 3, the four edges (102)-(108), front portion (110), and back portion of the recording device are sized to fit within the underside portion (16) of the lid (12) of the jewelry box (10) such that when the jewelry box (10) is in an open configuration, the recording device (100) creates a recording. In one embodiment, the recording device (100) records the expressions of a user opening the jewelry box (10). The recording device (100) may come in different forms to record the expressions. For example, the recording device may be a microphone to capture audio expression. Similarly, the recording device may be a still camera to capture still images, a video camera to capture video, or a combination of a microphone, still camera, and video camera.

In use, a first user can pre-set the recording device (100) such that when a second user converts the jewelry box (10) from a closed configuration to an open configuration, the act of opening the lid (12) immediately signals the recording device (100) to begin recording. In one embodiment, the recording device (100) may be configured to record approximately 60 seconds of video footage, audio footage, and/or a pre-set number of still images.

The buttons (141), (142) of the recording device (100) control functions of the recording device (100). In one embodiment, one of the buttons (141) or (142) is used to play back the recording to a user following a recording session, and another one of the buttons (141) or (142) may be used to re-arm the recording device (100), so it will record another segment the next time the lid is placed in a raised position. Similarly, in one embodiment the recording device (100) is pre-set such that a user is limited to playing back the recording a certain number of times or may only create a limited number of recordings. Furthermore, in one embodiment, the recording device (100) may be pre-set to communicate to the user when such limitations are approaching a threshold. For example, the recording device may be designed so that it will allow a particular recording to be played a set number of times, but after that limit a message would be revealed to the user that limits further playing of the recordation. Upon return of the box (10) to the vendor, the recordation may be converted to an alternate medium or platform. Aside from the buttons (141), (142), the position of the top portion (14) with respect to the bottom portion (24) may control operability of the recording device (100). In one embodiment, the recording device (100) is in an off position when the top and bottom lips meet or when the lips of the top and bottom portions are within a preset distance. When the lips are separated beyond a preset distance, the recording device (100) is set to an on position and record audio, video, and/or still images. Accordingly, the opening and closing of the box (10) control operation of the recording device by activating or de-activating the camera in response to motion and/or separation of the top and bottom portions of the box.

In one embodiment, the recording device (100) is hidden within the jewelry box (10). As illustrated in FIGS. 2 and 3, the recording device (100) is held within the underside (16) of the lid (12) of the jewelry box (10). A covering (not shown) camouflages the recording device so that it is not readily visible to a user, and at the same time includes a portion that is transparent to the eye of the recording device (100). The camouflage enables the user to be unaware that the recording device (100) is present and that it is recording his/her reaction when the jewelry box (10) is converted from a closed to an open configuration.

The recordation of an event by the recording device (100) may be transferred to a separate and more permanent recordable media, such as a DVD, VHS tape, pictures, etc. For example, such a transfer could be accomplished by a USB cable or some other computer connection wherein the recording may be transferred to a personal computer, color printer, etc.

The modified jewelry box with a recording instrument enables capture of data associated with opening of the box. The recording instrument is positioned to capture the face of the person opening the container and to record an associated facial expression.

Alternative Embodiments

It will be appreciated that, although specific embodiments of the invention have been described herein for purposes of illustration, various modifications may be made without departing from the spirit and scope of the invention. In particular, the invention should not be limited to a jewelry box. The container may be in the form of a non-jewelry container wherein the recording device is positioned to capture the face of the person opening the container to document potential theft of an item housed in the container.

The container might have a weighted base, to keep the device from being top-heavy when the lid, which contains the video screen, was open. The lid could be designed to operate somewhat as a parabolic microphone, to better enable the recording of sound in noisy environments such as restaurants. The device could act just like a traditional old-fashioned music box, playing a favored song when the lid was opened, in addition to playing back the video. The device could also act as a security device, secretly recording the facial features of a person who has opened the box without permission and possibly taken jewelry that they do not own. It could also show various types of slide shows, including ads for wedding-related products, for use when it was still in the jewelry store for instance. The device as described here could also be used in a drastically different manner than described here—it could be used to present an outgoing message before going in to record mode. In this mode, the person giving the gift could send a message to the recipient, such as "sorry I could not be there for our anniversary, but here is a little present to make up for it."

Furthermore, the recording device may be hidden within the underside of the lid of the jewelry box such that a user's facial expressions while opening the jewelry box may be recorded without the user realizing the recording device is present. In one embodiment, the recording device is a digital video camera containing a lens and a plurality of hidden buttons adapted to control certain functional aspects of the camera. For example, a first button could be adapted to play back the recording on the camera; a second button could re-arm the camera to begin recording the next time the lid was opened again. Except for instances where the camera had been "armed" to record the next time the lid was raised, the device would normally play back whatever video was currently captured in the device whenever the lid is raised.

In a further embodiment the recording device could record a video of approximately 60 seconds of facial expressions of the user or a pre-set number of sequential pictures of the facial expressions of the user. This recording would then be writable to a separate recordable media such as a DVD, VHS tape, etc.

Accordingly, the scope of protection of this invention is limited only by the following claims and their equivalents.

I claim:

1. A storage apparatus comprising:

a jewelry box of a standard size and shape with a lid and a base, and a jewelry item housed in said base;

said lid having a top portion and an underside portion that meet at a first lip;

said base having a top portion and a bottom portion that meet at a second lip;

said lid is pivotably attached to said base by a hinge connected to said first lip and said second lip to allow for both an open configuration and a closed configuration of said jewelry box; and a recording device mounted within said jewelry box such that when a user converts said jewelry box into said open configuration from said closed configuration, said recording device records said user.

2. The apparatus of claim 1, wherein said recording device is a digital video camera.

3. The apparatus of claim 2, wherein said video camera is hidden between said top portion and said underside of said lid such that said video camera is undetectable by said user.

4. The apparatus of claim 2, further comprising a button in communication with said recording device to control operation of said device.

5. The apparatus of claim 4, wherein operation of said device includes play-back of said recording, download of said recording to storage media, and a re-arm of said recording device to record a segment the next time said lid is placed in a raised position.

6. The apparatus of claim 1, wherein said recording device is motion activated such that the recording device is activated when said lid is pivoted away from said base beyond a set threshold distance.

7. The apparatus of claim 1, wherein said recording device Produces a recording in the form of a video segment.

8. The apparatus of claim 1, wherein said recording device produces a recording in the form of a sequence of still images.

9. The apparatus of claim 1, wherein said recording device produces a recording transferable from said recording device to a recordable media.

10. The apparatus of claim 9, wherein said recordable media is a DVD.

11. The apparatus of claim 9, wherein said recordable media is a VHS tape.

* * * * *